US009372449B1

(12) United States Patent
Torimoto

(10) Patent No.: US 9,372,449 B1
(45) Date of Patent: Jun. 21, 2016

(54) FIXING DEVICE AND IMAGE FORMING APPARATUS INCLUDING THE SAME

(71) Applicant: KYOCERA Document Solutions Inc., Osaka (JP)

(72) Inventor: Masaru Torimoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/757,535

(22) Filed: Dec. 23, 2015

(30) Foreign Application Priority Data

Dec. 26, 2014 (JP) ..... 2014-264644

(51) Int. Cl.
*G03G 15/20* (2006.01)

(52) U.S. Cl.
CPC ..... *G03G 15/2039* (2013.01); *G03G 15/2028* (2013.01)

(58) Field of Classification Search
USPC ..... 399/38, 67–70, 107, 110, 122, 320, 399/328, 329; 219/216, 619
See application file for complete search history.

(56) References Cited

U.S. PATENT DOCUMENTS 8,064,814 B2 * 11/2011 Kagawa ..... G03G 15/2025 399/327
8,693,933 B2 * 4/2014 Tsukioka ..... G03G 15/2053 399/329
8,731,429 B2 * 5/2014 Asami ..... G03G 15/2042 399/329
2010/0290796 A1 11/2010 Sato

FOREIGN PATENT DOCUMENTS

JP 5-2350 1/1993

* cited by examiner

*Primary Examiner* — Hoan Tran
(74) *Attorney, Agent, or Firm* — Wenderoth, Lind & Ponack, L.L.P.

(57) ABSTRACT

A peripheral surface of a pressing roller in a fixing device has a pair of drive transmission surface portions and a paper passing surface portion. The drive transmission surface portions are respectively formed at both end portions of the pressing roller in an axial direction to transmit rotational driving force of the pressing roller to the fixing belt. The paper passing surface portion is positioned between the pair of drive transmission surface portions and has a dynamic friction coefficient lower than that of the drive transmission surface portion. It is determined whether a slip of the fixing belt occurs based on a difference between temperatures detected by a first temperature sensor that detects the temperature of the drive transmission surface portion and a second temperature sensor that detects the temperature of the paper passing surface portion. Thereby, even a slight slip of the fixing belt 42 is reliably detected.

11 Claims, 8 Drawing Sheets

FIXING DEVICE AND IMAGE FORMING APPARATUS INCLUDING THE SAME

CROSS-REFERENCE TO RELATED APPLICATION

This application is based upon and claims the benefit of priority from Japanese Patent Application No. 2014-264644 filed on Dec. 26, 2014, the entire contents of which are incorporated herein by reference.

BACKGROUND

The technology of the present disclosure relates to a fixing device and an image forming apparatus including the same.

Conventionally, as a fixing device mounted in an electrophotographic image forming apparatus, there has been known a fixing device including an endless fixing belt, a heating body, and a pressing roller. The heating body abuts an inner peripheral surface of the fixing belt and the pressing roller abuts an outer peripheral surface of the fixing belt. The pressing roller is brought into press-contact with the heating body while interposing the fixing belt between the pressing roller and the heating body. In this state, the pressing roller is driven by a motor, so that the fixing belt is rotated. In the fixing device, a paper passes through between the fixing belt and the pressing roller, so that a toner image is fixed to the paper. According to this, since a fixing member for fixing a toner to a paper is configured with a belt member with a thin thickness, heat dissipation of the fixing member is enhanced, so that it is possible to prevent an offset phenomenon of a toner.

In this type of fixing device, there is a case in which the fixing belt slips with respect to the pressing roller, so that the rotation speed of the fixing belt is reduced or the fixing belt stops. As a consequence, there is a problem that a predetermined part of the fixing belt is locally heated by the heating body and thus the belt is broken.

In this regard, there has been proposed a fixing device which detects the temperature of the fixing belt by a thermistor, and determines slip abnormality when the rate of change of the detected belt temperature according to the passage of time exceeds a predetermined threshold value.

SUMMARY

A fixing device according to one aspect of the present disclosure includes a heating part, a fixing belt, an abutting member, and a pressing roller. The fixing belt is heated by the heating means. The abutting member abuts an inner peripheral surface of the fixing belt. The pressing roller is brought into press-contact with the abutting member while interposing the fixing belt between the pressing roller and the abutting member. The pressing roller is rotationally driven in the abutting state to allow the aforementioned fixing belt to be rotationally driven. Furthermore, the aforementioned fixing device is configured to allow a paper to pass through between the aforementioned fixing belt and the aforementioned pressing roller, thereby fixing a toner image to the paper.

Furthermore, a peripheral surface of the aforementioned pressing roller has a pair of drive transmission surface portions and a paper passing surface portion. The pair of drive transmission surface portions are respectively formed at both end portions of the pressing roller in an axial direction to transmit rotational driving force of the pressing roller to the aforementioned fixing belt. The paper passing surface portion is positioned between the pair of drive transmission surface portions. The paper passing surface portion has a low dynamic friction coefficient for the aforementioned fixing belt as compared with the pair of drive transmission surface portions. Furthermore, the aforementioned fixing device further includes a first temperature sensor, a second temperature sensor, and a slip determination unit. The first temperature sensor is arranged to face the aforementioned drive transmission surface portion and detects a temperature of the drive transmission surface portion. The second temperature sensor is arranged to face the aforementioned paper passing surface portion and detects a temperature of the paper passing surface portion. The slip determination unit determines whether a slip of the aforementioned fixing belt occurs with respect to the aforementioned pressing roller based on a temperature difference between the temperatures detected by the aforementioned first and second temperature sensors.

DETAILED DESCRIPTION

Hereinafter, an example of an embodiment of the technology of the present disclosure will be described in detail on the basis of the drawings. It is noted that the technology of the present disclosure is not limited to the following embodiments.

Embodiment

Figure 1:
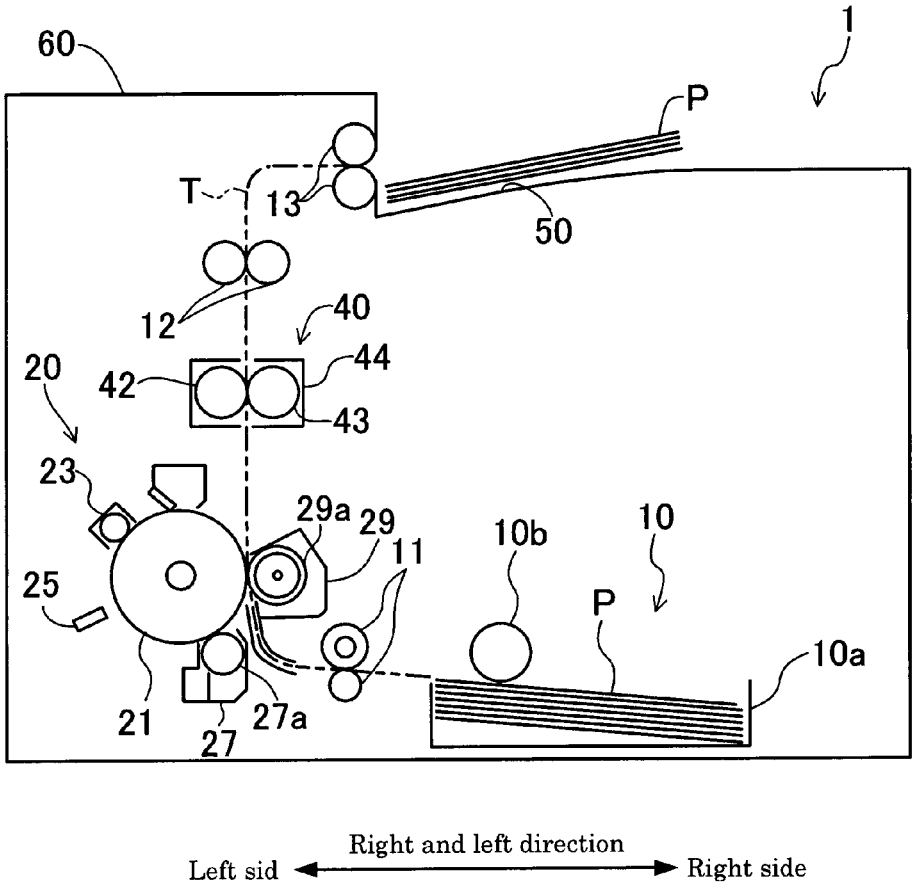
FIG. 1 is a schematic diagram illustrating an internal structure of an image forming apparatus including a fixing device in an embodiment.

FIG. 1 illustrates an image forming apparatus 1 in the present embodiment. The image forming apparatus 1 includes a monochrome laser printer in the present embodiment. In the following description, a "front side" and a "rear side" indicate a "front side" and a "rear side" (a front side and a back side in a direction perpendicular to the paper surface of FIG. 1) of the image forming apparatus 1, and a "left side" and a "right side" indicate a "left side" and a "right side" when the image forming apparatus 1 is viewed from the front side.

The image forming apparatus 1 has a paper feeding unit 10, an image creating unit 20, a fixing unit (a fixing device) 40, a paper discharge unit 50, and a casing 60. On a paper conveyance path T from the paper feeding unit 10 to the paper discharge unit 50, a plurality of conveying roller pairs 11 to are arranged to convey a paper P while interposing it therebetween. The aforementioned paper feeding unit 10 is arranged at a lower portion of the casing 60. The paper feeding unit 10 has a paper feeding cassette 10*a* in which the paper P having a sheet shape is accommodated, and a pick-up roller 10*b* for taking out the paper P in the paper feeding cassette 10*a* and sending out the paper P to an exterior of the cassette. The paper P sent out to the exterior of the cassette from the paper feeding cassette 10*a* is supplied to the image creating unit 20 via the conveying roller pair 11.

The image creating unit 20 has a photosensitive drum 21, a charging device 23, an exposure device 25, a developing device 27, a transfer device 29, and a toner container (not illustrated). In the image creating unit 20, the peripheral surface of the photosensitive drum 21 is electrified by the charging device 23, and then laser light based on document image data (for example, image data of a document image received from an external terminal) is irradiated to the surface of the photosensitive drum 21 by the exposure device 25, so that an electrostatic latent image is formed. The electrostatic latent image formed (carried) on the surface of the photosensitive drum 21 is developed by the developing device 27 as a toner image. The toner image developed by the developing device 27 is transferred to the paper P supplied from the paper feeding unit 10 by the transfer device 29. The paper P after the transfer is supplied to the fixing unit 40 by a transfer roller 29*a* of the transfer device 29 and the photosensitive drum 21.

The fixing device 40 presses and heats the paper P supplied from the aforementioned image creating unit 20 between a fixing belt 42 and a pressing roller 43, thereby fixing the toner image to the paper P. Then, the paper P with the toner image fixed by the fixing device 40 is sent out to a downstream side according to the rotation of the fixing belt 42 and the pressing roller 43. The sent paper P is discharged to the paper discharge unit 50 formed on an upper surface of the casing 60 via the plurality of conveying roller pairs 12 and 13.

Figure 2:
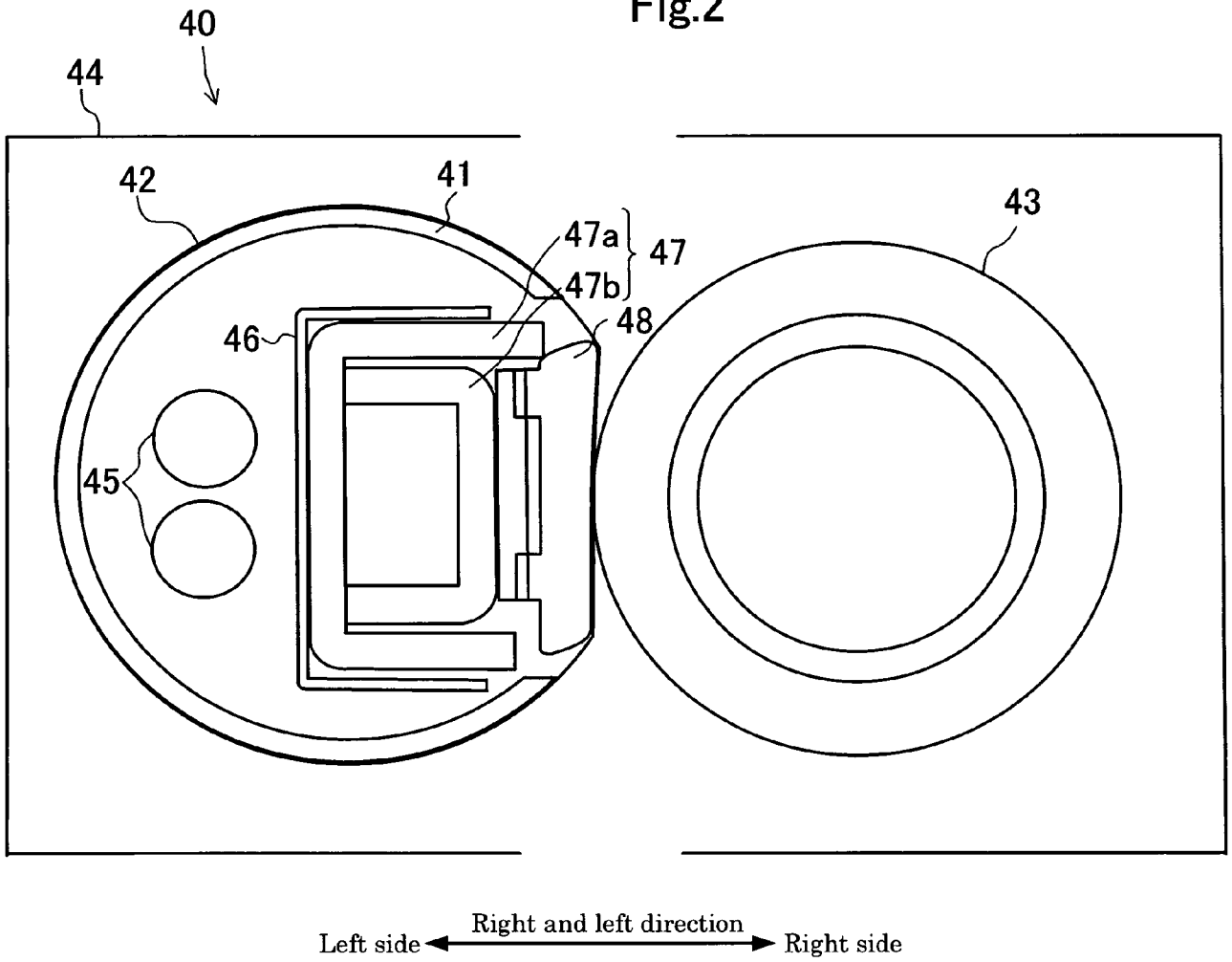
FIG. 2 is a schematic diagram illustrating an internal structure of a fixing device.
Figure 3:
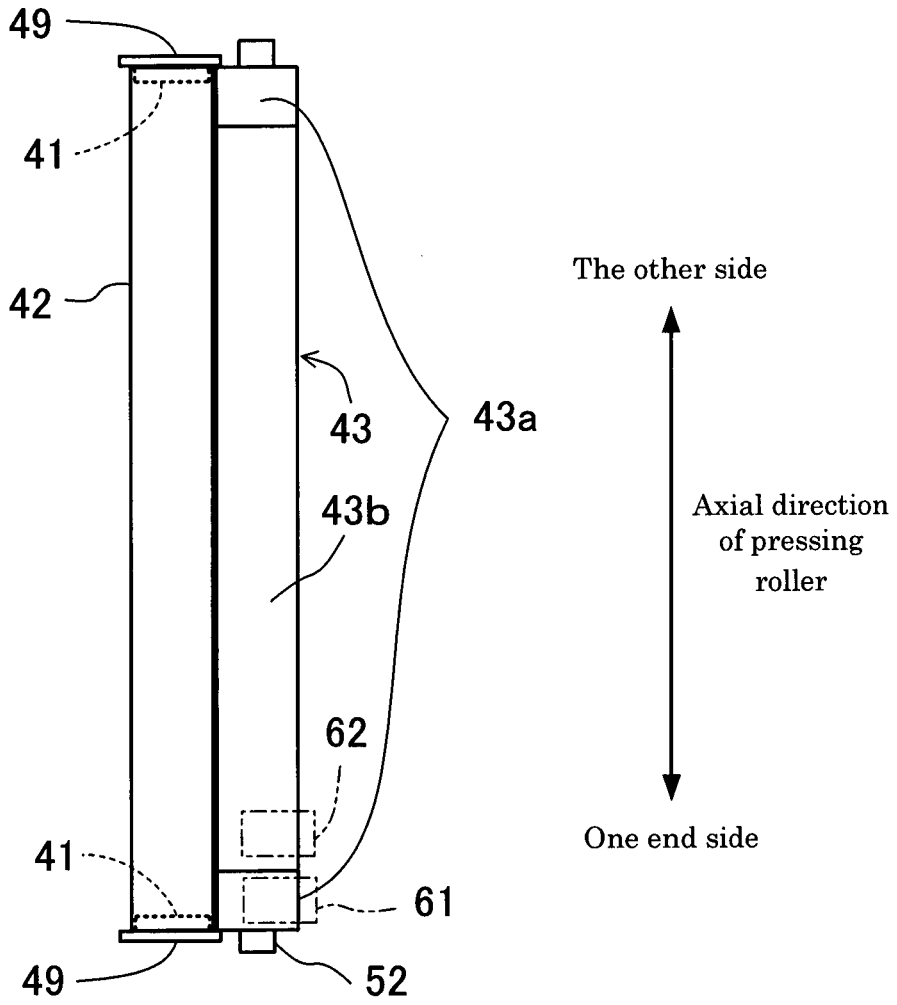
FIG. 3 is a schematic diagram of a fixing belt and a pressing roller when viewed from an upper side.

As illustrated in FIG. 2 and FIG. 3, the fixing device 40 has the fixing belt 42, the pressing roller 43, and a housing for accommodating the fixing belt 42 and the pressing roller 43. The fixing belt 42 is formed in an approximately cylindrical shape which is long in a front and rear direction. The fixing belt 42 has flexibility and is formed in an endless shape in a circumferential direction. Both end portions of the fixing belt 42 in the front and rear direction are supported by an insertion support part 41. The insertion support part 41 is formed in an arc shape (a rightward C shape) when viewed from the front and rear direction. The insertion support part 41 protrudes from a side plate 49 (see FIG. 3) and is fixed to the housing 44 via the side plate 49.

The fixing belt 42 is provided at a radial direction inside thereof with a pair of heaters (heating parts) 45, a reflective plate 46, a support member 47, and an abutting member 48. The aforementioned pair of heaters 45 are configured by a halogen heater. The aforementioned reflective plate 46 is arranged at a right side of the heaters 45. The reflective plate 46 is formed in a sectional U shape opened rightward and is mounted at the support member 47. The reflective plate 46 reflects radiant heat, which is radiated from the heaters 45, toward an inner peripheral surface of the fixing belt 42. The heat from the heaters 45 is transmitted from the inner peripheral surface to an outer peripheral surface of the fixing belt 42. In this way, the outer peripheral surface of the fixing belt 42 is heated. The heaters 45 are controlled by a controller 100 (see FIG. 4) to be described later. The controller (a slip determination unit) 100 controls the supply of power to the heaters 45 based on temperature information from a belt temperature detection sensor (not illustrated) arranged in the vicinity of the fixing belt 42, thereby controlling the temperature of the outer peripheral surface of the fixing belt 42 to a target temperature.

The aforementioned support member 47 is formed by combining a pair of sheet metals 47*a* and 47*b* extending in the front and rear direction to have a sectional U shape with each other. The aforementioned abutting member 48 is mounted at a side opposite to a side, at which the reflective plate 46 is mounted, in the support member 47. The abutting member 48 is formed in a flat plate shape which is long in the front and rear direction. An upper end portion of a right surface of the abutting member 48 may also be formed in an R curved shape curved rightward (the pressing roller 43 side toward a downstream side from an upstream side of a paper conveyance direction) from a lower side to an upper side. The aforementioned fixing belt 42 is interposed between the abutting member 48 and the pressing roller 43 and is modified. Accordingly, the inner peripheral surface of the fixing belt abuts the approximately entire right surface of the abutting member 48.

The pressing roller 43 is formed in a columnar shape extending in the front and rear direction and is supported to the housing 44 via a support shaft 52 arranged coaxially with the roller 43. An outer peripheral surface of the pressing roller 43 abuts the outer peripheral surface of the fixing belt 42. The pressing roller 43 is brought into press-contact with the abutting member 48 while interposing the fixing belt 42 between the pressing roller 43 and the abutting member 48. The pressing roller 43 is a driving roller which is rotationally driven by a motor (not illustrated). The fixing belt 42 is rotated according to the rotation of the pressing roller 43. Furthermore, the paper P conveyed from the image creating unit 20 passes through a nip portion formed between the fixing belt 42 and the pressing roller 43, so that a toner image is fixed to the paper.

As illustrated in FIG. 3, the outer peripheral surface of the aforementioned pressing roller 43 has a pair of drive transmission surface portions 43*a* and a paper passing surface portion 43*b*. The pair of drive transmission surface portions 43*a*, have a function of transmitting rotational driving force of the pressing roller 43 to the fixing belt 42. The pair of drive transmission surface portions 43*a* are respectively formed at both end portions of the pressing roller 43 in an axial direction. Each drive transmission surface portion 43*a*, for example, is configured with an elastic member such as urethane and silicon rubber. In this way, a dynamic friction coefficient of the drive transmission surface portions 43*a* is sufficiently increased, so that it is possible to reliably transmit the rotational driving force of the pressing roller 43 to the fixing belt 42.

The paper passing surface portion 43*b* is a surface portion through which the paper P passes, and is formed between the aforementioned pair of drive transmission surface portion 43*a* in the outer peripheral surface of the pressing roller 43. A dynamic friction coefficient of the paper passing surface portion 43*b* with respect to the fixing belt 42 is sufficiently smaller than the dynamic friction coefficient of the drive transmission surface portions 43*a* with respect to the fixing belt 42. In this way, it is possible to enhance the mold release properties of the paper P. The paper passing surface portion 43*b*, for example, is configured by a PFA tube.

Figure 4:
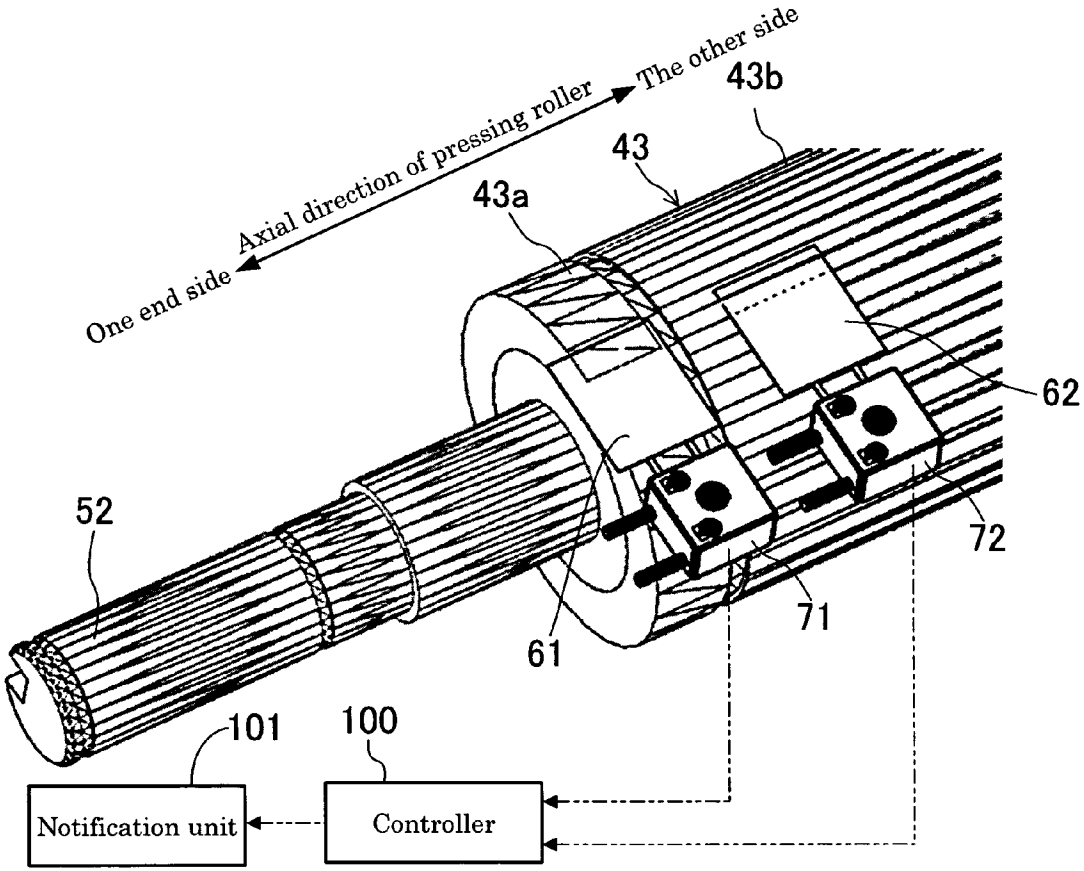
FIG. 4 is an enlarged perspective view of one end portion of a pressing roller in an axial direction.

As illustrated in FIG. 4, in the vicinity of the peripheral surface of the aforementioned pressing roller 43, first and second temperature sensors 61 and 62 are arranged so as to be adjacent to each other in the axial direction of the pressing roller 43. The first and second temperature sensors 61 and 62, for example, include a non-contact type thermistor and are connected to the controller 100 via terminal boxes 71 and 72. The first temperature sensor 61 is arranged to face the drive transmission surface portion 43*a* of one end side of the pressing roller 43 in the axial direction. The first temperature sensor 61 detects the temperature of the drive transmission surface portion 43*a* and outputs a detection temperature signal to the controller 100. The second temperature sensor 62 is arranged to face a part of the paper passing surface portion 43*b*, which is adjacent to the aforementioned drive transmission surface portion 43*a*. The second temperature sensor 62 detects the temperature of the paper passing surface portion 43*b* and outputs a detection temperature signal to the controller 100.

The controller 100 includes a microcomputer having a CPU, a ROM, a RAM and the like. The controller 100 calculates a difference between the detection temperatures of the first and second temperature sensors 61 and 62, and determines whether the fixing belt 42 slips with respect to the pressing roller 43 based on the calculated detection temperature difference. When it is determined that the fixing belt 42 slips, the controller 100 issues a notification instruction with respect to a notification unit 101. The notification unit 101 receives the instruction from the controller 100, and notifies a user of the slip (that is, the fact that the fixing belt 42 slips with respect to the pressing roller 43). The notification unit 101, for example, is configured by a speaker that emits an alarm sound or a lighting device that lights up an alarm lamp.

Figure 5:
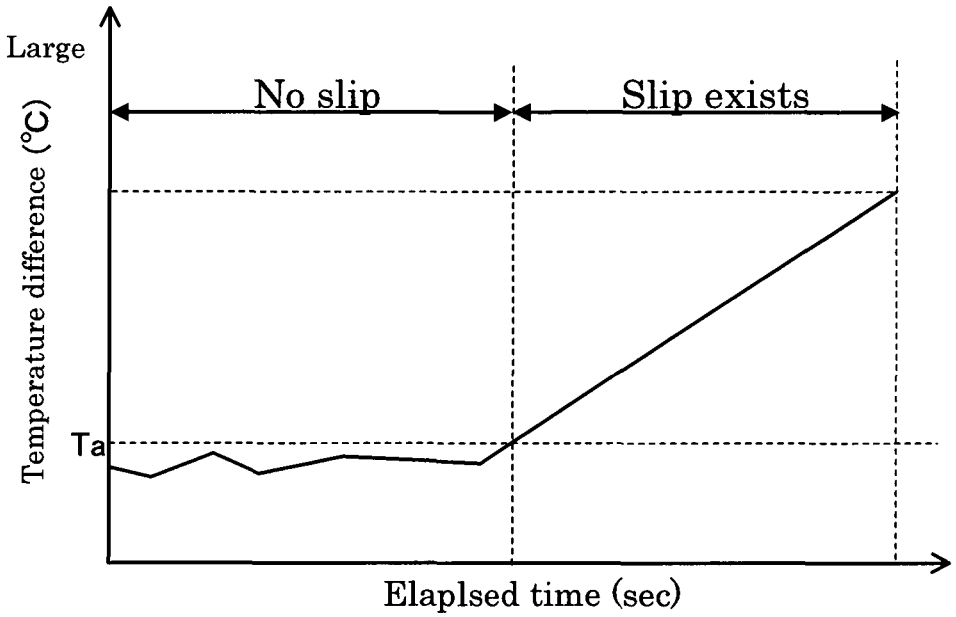
FIG. 5 is an explanation diagram for explaining slip determination control in a controller.

Next, with reference to FIG. 5, a slip determination method in the controller 100 will be described. FIG. 5 is a graph schematically illustrating a temporal change in the difference between the detection temperatures by the first and second temperature sensors 61 and 62. In the state in which the fixing belt 42 does not slip with respect to the pressing roller 43, a detection temperature difference is maintained to be almost constant even though there is a slight variation. However, when the fixing belt 42 starts to slip with respect to the pressing roller 43, the temperature of the peripheral surface of the pressing roller 43 starts to rise by friction. Herein, since the dynamic friction coefficient of the drive transmission surface portions 43*a* is higher than the dynamic friction coefficient of the paper passing surface portion 43*b*, frictional heat of the drive transmission surface portions 43*a* at the time of generation of a slip is higher than that of the paper passing surface portion 43*b*, so that the temperature difference between the two surface portions 43*a* and 43*b* gradually increases according to the passage of time. In the present embodiment, in this regard, the controller 100 determines whether the difference (the temperature difference of the drive transmission surface portion 43*a* and the paper passing surface portion 43*b*) between the detection temperatures of the first and second temperature sensors 61 and 62 exceeds a predetermined threshold value Ta, and determines that the aforementioned slip occurs when it is determined the difference exceeds the predetermined threshold value Ta while determining that the aforementioned slip does not occur when it is determined the aforementioned detection temperature difference is equal to or less than the predetermined threshold value Ta. It is noted that the predetermined threshold value Ta indicates a temperature which is equal to or slightly larger than the detection temperature difference of the first and second temperature sensors 61 and 62, which is expected to occur when the aforementioned slip has started, and is set in advance by an experiment and the like.

According to this, it is possible to reliably detect even a slight slip without missing the slight slip before the fixing belt 42 completely stops by a slip. Thus, a user, for example, can prevent the breakage of the fixing belt 42 through the turning-off and the like of power of the halogen heater 42*a* when the controller 100 has determined that the aforementioned slip occurs.

Herein, it is also considered to perform the slip determination on the basis of the temperature of only one of the drive transmission surface portion 43*a* and the paper passing surface portion 43*b*. However, in this case, even when only the heating temperature of the halogen heater 42*a* has increased, it may be erroneously determined that a slip has occurred. On the other hand, in the aforementioned embodiment, the slip determination is performed on the basis of the temperature difference of the drive transmission surface portion 43*a* and the paper passing surface portion 43*b*, it is possible to prevent such erroneous determination. That is, when only the heating temperature of the halogen heater 42*a* has increased, the temperatures of both the drive transmission surface portion 43*a* and the paper passing surface portion 43*b* increase to be equal to each other and thus there is no change in the detection temperature difference of the first and second temperature sensors 61 and 62. As with the present embodiment, if the slip determination is configured to be performed on the basis of the detection temperature difference of the first and second temperature sensors 61 and 62, such a situation (a situation that only the heating temperature of the halogen heater 42*a* increases) is not erroneously determined that a slip occurs.

Furthermore, in the aforementioned embodiment, the aforementioned first and second temperature sensors 61 and 62 are arranged to be adjacent to each other, so that it is possible to accurately detect the temperature difference between the drive transmission surface portion 43*a* and the paper passing surface portion 43*b*, which occurs by the slip of the fixing belt 42, by the controller 100. That is, for example, when the second temperature sensor 62 is arranged separate from the first temperature sensor 61, since heat sources existing around each of the temperature sensors 61 and 62 are also changed, it is not possible to distinguish whether the temperature difference of both temperature sensors 61 and 62 is caused by the slip of the fixing belt 42 or an influence of surrounding heat sources. Therefore, the slip determination accuracy in the controller 100 is reduced. On the other hand, in the aforementioned embodiment, since the aforementioned first and second temperature sensors 61 and 62 are arranged adjacent to each other, heat source environments around both first and second temperature sensors 61 and 62 are allowed to be equal to each other, so that it is possible to prevent the accuracy of the aforementioned slip determination from being reduced.

Furthermore, in the aforementioned embodiment, the drive transmission surface portions 43*a* is configured by silicon rubber or urethane and the paper passing surface portion 43*b* is configured by a PFA tube.

According to this configuration, it is possible to allow the dynamic friction coefficient to be greatly different in the drive transmission surface portion 43*a* and the paper passing surface portion 43*b*. In this way, when the slip of the fixing belt 42 has occurred, a temperature difference between the drive transmission surface portion 43*a* and the paper passing surface portion 43*b* is allowed to easily occur, so that it is possible to further improve slip determination accuracy in the controller 100.

Furthermore, in the aforementioned embodiment, when the controller 100 determines that the fixing belt 42 slips, the determination result is notified to a user by the notification unit 101. Consequently, the user can recognize that the fixing belt 42 slips based on the notification information from the notification unit 101, and make appropriate countermeasures.

Furthermore, since the aforementioned image forming apparatus 1 includes the aforementioned fixing unit 40, it is possible to prevent the degradation of image quality due to the slip of the fixing belt 42 and the malfunction of the image forming apparatus 1 due to the breakage of the fixing belt 42 by maximally avoiding the slip of the fixing belt 42.

Embodiment 2

Figure 6:
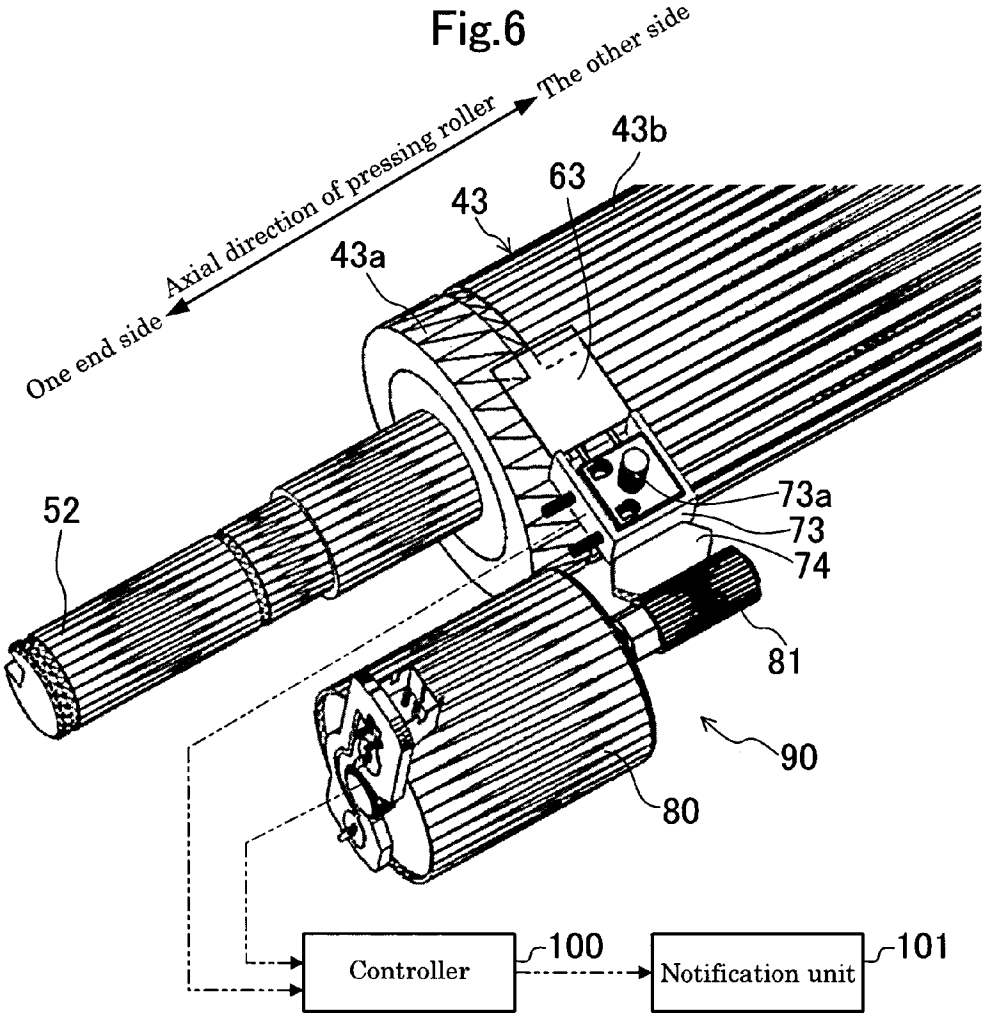
FIG. 6 is a diagram corresponding to FIG. 4, which illustrates an embodiment 2.

FIG. 6 illustrates an embodiment 2. This embodiment is different from the aforementioned embodiment 1 in that the temperatures of the drive transmission surface portion 43*a* and the paper passing surface portion 43*b* are detected by one temperature sensor 63. The same reference numerals are used to designate the same elements as those of FIG. 4 and a detailed description thereof will be omitted.

That is, in the present embodiment, only one temperature sensor 63 is provided at a boundary part between the drive transmission surface portion 43*a* and the paper passing surface portion 43*b*. The temperature sensor 63 is connected to the controller 100 via a terminal box 73. At a center portion of an upper surface of the terminal box 73, a rotating shaft 73*a* is vertically fixed. The rotating shaft 73*a* is rotatably supported to a fixed bracket (not illustrated). The terminal box 73 is mounted at a lateral side thereof with a gear plate 74 having an approximately fan shape. At a peripheral surface of the gear plate, a worm gear part is formed.

Figure 7:
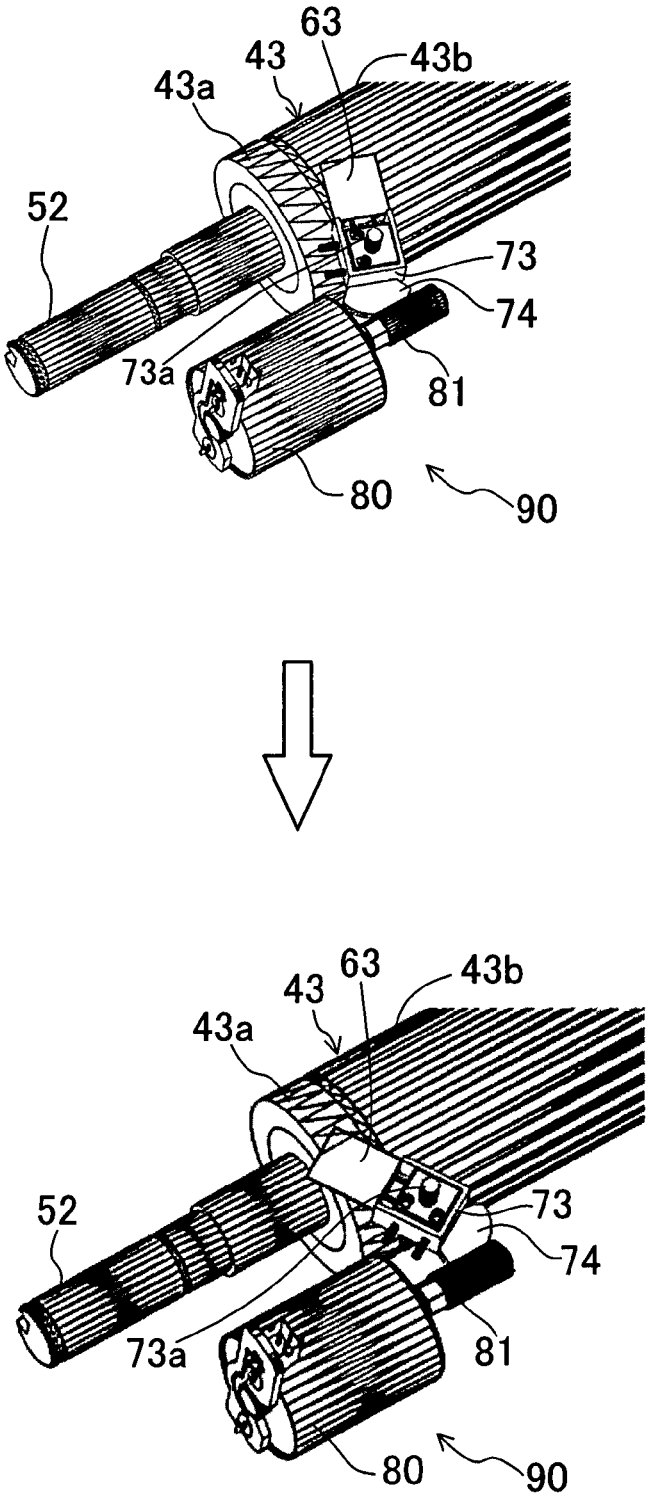
FIG. 7 is an explanation diagram for explaining an operation of a position switching mechanism.

The fixing device 40 of the present embodiment includes a position switching mechanism 90 that switches the temperature sensor 63 to a first position facing the drive transmission surface portion 43*a* and a second position facing the paper passing surface portion 43*b* at predetermined time intervals. The position switching mechanism 90 has a sensor driving motor 80, and a pinion gear 81 which is fixed to an output shaft of the motor 80 and engages with the worm gear part of the aforementioned gear plate 74. When the pinion gear 81 is rotationally driven by the sensor driving motor 80, the gear plate 74 is rotated by employing the rotating shaft 73*a* as a fulcrum. As a consequence, the terminal box 73 is rotated together with the temperature sensor 63 by employing the rotating shaft 73*a* as a fulcrum, resulting in a change in the position of the temperature sensor 63 (see FIG. 7). The sensor driving motor 80 receives an instruction from the controller 100 and switches the rotation direction of the pinion gear 81 at predetermined time intervals, thereby switching the position of the temperature sensor 63 to the first position and the second position at predetermined time intervals.

Furthermore, the controller 100 determines whether the fixing belt 42 slips with respect to the pressing roller 43 based on a temperature difference between the detection temperatures of the temperature sensor 63 at the first position and at the second position. Since this determination method is similar to that of the aforementioned embodiment 1, a description thereof will be omitted.

As described above, in the aforementioned embodiment 2, differently from the embodiment 1 in which the two temperature sensor 61 and 62 are used, one temperature sensor 63 is used and the position of the temperature sensor 63 is switched to the first position and the second position by the position switching mechanism 90. In this way, since it is not necessary to perform calibration work and the like for allowing the detection accuracy of the two temperature sensor 61 and 62 to coincide with each other, it is possible to improve maintainability.

Other Embodiments

Figure 8:
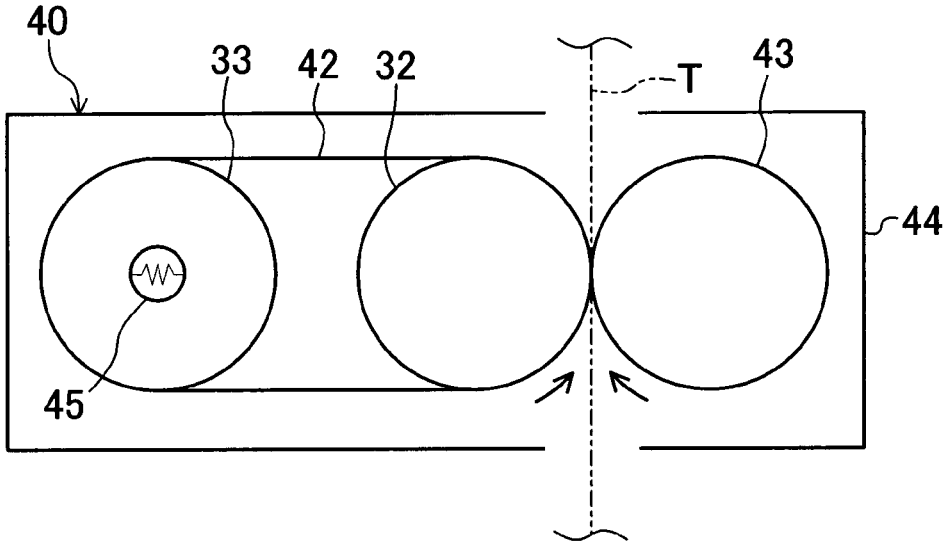
FIG. 8 is a diagram corresponding to FIG. 2, which illustrates another embodiment.

In the aforementioned embodiments, the abutting member 48 is configured by a fixed member having a flat plate shape; however, the technology of the present disclosure is not limited thereto, and for example, as illustrated in FIG. 8, the abutting member 48 may also be configured by a support roller 32 which freely rotates. In this example of FIG. 8, the fixing belt 42 is wound around the support roller 32 and a heating roller 33 provided at a left side of the support roller 32. The heating roller 33 has a heater 45 therein. The outer peripheral surface of the fixing belt 42 is heated by heat transmitted from the heater 45 via the heating roller 33. The technology of the present disclosure can also be applied to such a fixing device 40.

In the aforementioned each embodiment, the drive transmission surface portion 43*a* is configured by an elastic member; however, the technology of the present disclosure is not limited thereto, and the drive transmission surface portion 43*a* may also have any shapes or materials as long as it has a dynamic friction coefficient higher than that of the paper passing surface portion 43*b*.

In the aforementioned each embodiment, the example, in which the image forming apparatus 1 is a printer, has been described; however, the technology of the present disclosure is not limited thereto and the image forming apparatus 1 may also include a copy machine, a multifunctional peripheral and the like.

Furthermore, the technology of the present disclosure is not limited to the aforementioned each embodiment, and the technical scope of the present disclosure includes configurations obtained by appropriately combining the aforementioned embodiments with each other.

What is claimed is:

1. A fixing device, which comprises a heating means, a fixing belt heated by the heating means, an abutting member abutting an inner peripheral surface of the fixing belt, and a pressing roller brought into press-contact with the abutting member while interposing the fixing belt between the pressing roller and the abutting member and rotationally driven in the abutting state to allow the fixing belt to be rotationally driven, and allows a paper to pass through between the fixing belt and the pressing roller so as to fix a toner image to the paper, wherein a peripheral surface of the pressing roller has a pair of drive transmission surface portions respectively formed at both end portions of the pressing roller in an axial direction to transmit rotational driving force of the pressing roller to the fixing belt, and a paper passing surface portion positioned between the pair of drive transmission surface portions and having a lower dynamic friction coefficient for the fixing belt as compared with the pair of drive transmission surface portions, and the fixing device further comprises:

a first temperature sensor arranged to face the drive transmission surface portion and detecting a temperature of the drive transmission surface portion;

a second temperature sensor arranged to face the paper passing surface portion and detecting a temperature of the paper passing surface portion; and a slip determination unit that determines whether a slip of the fixing belt occurs with respect to the pressing roller based on a temperature difference between the temperatures detected by the first and second temperature sensors.

2. The fixing device of claim 1, wherein the first and second temperature sensors are arranged adjacent to each other.

3. The fixing device of claim 1, wherein the slip determination unit is configured to determine that the slip Occurs when the temperature difference has exceeded a predetermined threshold value, and determine that the slip does not occur when the temperature difference is equal to or less than the predetermined threshold value.

4. The fixing device of claim 1, wherein the drive transmission surface portions is configured by silicon rubber or urethane and the paper passing surface portion is configured by a PFA tube.

5. The fixing device of claim 1, further comprising:

a notification unit that notifies a user of occurrence of the slip when the slip determination unit has determined that the slip occurs.

6. An image forming apparatus comprising the fixing device of claim 1.

7. A fixing device, which comprises a heating means, a fixing belt heated by the heating means, an abutting member abutting an inner peripheral surface of the fixing belt, and a pressing roller brought into press-contact with the abutting member while interposing the fixing belt between the pressing roller and the abutting member and rotationally driven in the abutting state to allow the fixing belt to be rotationally driven, and allows a paper to pass through between the fixing belt and the pressing roller so as to fix a toner image to the paper, wherein a peripheral surface of the pressing roller has a pair of drive transmission surface portions respectively formed at both end portions of the pressing roller in an axial direction to transmit rotational driving force of the pressing roller to the fixing belt, and a paper passing surface portion positioned between the pair of drive transmission surface portions and having a lower dynamic friction coefficient for the fixing belt as compared with the pair of drive transmission surface portions, and the fixing device further comprises:

a temperature sensor arranged to face a peripheral surface of the pressing roller and detecting a temperature of the peripheral surface;

a position switching mechanism that switches the temperature sensor to a first position, at which a temperature of the drive transmission surface portion is detectable while facing the drive transmission surface portion, and a second position, at which a temperature of the paper passing surface portion is detectable while facing the paper passing surface portion, at predetermined time intervals; and a slip determination unit that determines whether a slip of the fixing belt occurs with respect to the pressing roller based on a temperature difference between the temperatures detected by the temperature sensor at the first position and the second position.

8. The fixing device of claim 7, wherein the slip determination unit is configured to determine that the slip occurs when the temperature difference has exceeded a predetermined threshold value, and determine that the slip does not occur when the temperature difference is equal to or less than the predetermined threshold value.

9. The fixing device of claim 7, wherein the drive transmission surface portions is configured by silicon rubber or urethane and the paper passing surface portion is configured by a PFA tube.

10. The fixing device of claim 7, further comprising:

a notification unit that notifies a user of occurrence of the slip when the slip determination unit has determined that the slip occurs.

11. An image forming apparatus comprising the fixing device of claim 7.

* * * * *